US005294115A

United States Patent [19]

Phillips et al.

[11] Patent Number: 5,294,115

[45] Date of Patent: Mar. 15, 1994

[54] GAME HOOP APPARATUS

[76] Inventors: Charles B. Phillips, 180 W. End Ave. (18-L), New York, N.Y. 10023; Ronald A. Wiecek, 26430 127 St. SE., Monroe, Wash. 98272

[21] Appl. No.: 13,936

[22] Filed: Feb. 5, 1993

[51] Int. Cl.[5] ..... A63B 59/00

[52] U.S. Cl. ..... 273/67 R

[58] Field of Search ..... 273/67 R, 73 R, 76, 273/318

[56] References Cited

U.S. PATENT DOCUMENTS 4,443,013 4/1984 Burt ..... 273/67 R 4,844,478 7/1989 Kessler ..... 273/67 R

*Primary Examiner*—Mark S. Graham

*Attorney, Agent, or Firm*—Charles E. Baxley

[57] ABSTRACT

A game hoop apparatus includes a hoop member which is formed of a lightweight material. A resilient membrane is attached to the hoop member at selected locations by loop portions which are formed as part of the resilient membrane. A pair of spaced apart handle portions are mounted on the hoop member at selected locations, thereby allowing a user to grasp the apparatus using both hands in order to use the resilient member to rebound a ball which has been propelled by another player having an identical apparatus.

1 Claim, 3 Drawing Sheets

GAME HOOP APPARATUS

BACKGROUND OF THE INVENTION

This invention relates generally to game apparatuses and more particularly to a game apparatus which can be used both indoors and outdoors for play with a ball. The prior art related to apparatuses for play with balls include numerous and well known examples of racquet or paddle apparatuses which are used in games such as: tennis, racquet ball, table tennis, squash and paddle ball. In each of these games a player holds a racquet or paddle in one hand and consequently exercises eye-hand coordination skills with only one hand while the other hand is used mainly for balance. In addition, in each of the above racquets or paddles impact surfaces are of relatively stiff construction.

OBJECTS AND SUMMARY OF THE INVENTION

Description of the System

It is an object of the present invention to provide a game hoop apparatus with which a player can use both hands during play.

Another object of the present invention is to provide a game hoop apparatus with which a player is able to develop bilateral coordination skills.

Another object of the present invention is to provide a game hoop apparatus which can be used both indoors and outdoors.

Another object of the present invention is to provide a game hoop apparatus which provides a relatively soft elastic rebound surface.

Yet another object of the present invention is to provide a game hoop apparatus which includes a relatively small number of simple component parts each of which can be manufactured economically, resulting in a relatively low overall cost.

The foregoing and other objects and advantages of the invention will appear more clearly hereinafter.

In accordance with the present invention, there is provided a game hoop apparatus which includes a hoop member which is formed of a lightweight material such as plastic. A resilient membrane is attached to the hoop member at selected locations by means of loop portions which are formed as part of the resilient membrane A pair of handle portions are mounted on the hoop member at selected locations which are spaced apart from each other a distance which is less than the diameter of the hoop member. The handles are made of a soft foam material which encircles the hoop member, making it easy for a player to place one hand on each handle. The player can grasp the handles and use the apparatus to propel a ball by letting the ball impact onto and then rebound from the membrane. Play using the apparatus can be solitary in which case a single player uses the apparatus to propel repeatedly a ball into the air or, more typically, a pair of players each holding a game hoop apparatus can use the apparatus to propel a ball from player to player.

Resilience of the membrane enables the apparatus to deflect easily when impacted by a ball which has been thrown or propelled toward the apparatus and then rebound, thereby enabling a player to return or propel the ball with as much or as little force as is desired. Use of the two handles ensures development of agility and bilateral exercise in a manner which is both challenging and physically beneficial.

DESCRIPTION OF THE DRAWINGS

Other important objects and advantages of the invention will be apparent from the following detailed description taken in conjunction with the accompanying drawings in which.

DETAILED DESCRIPTION OF THE INVENTION

Figure 1:
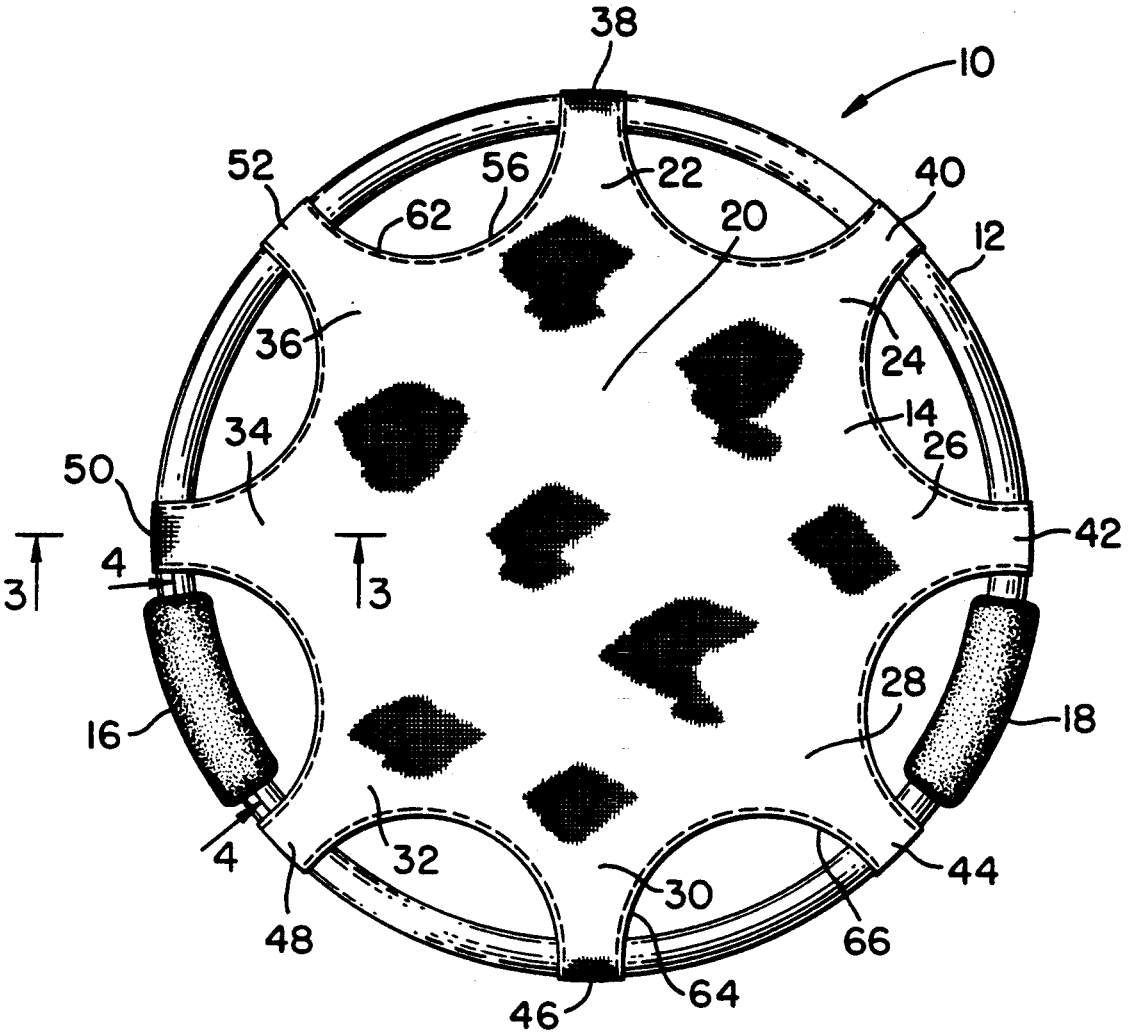
FIG. 1 is a plan view of the game hoop apparatus of this invention.
Figure 2:
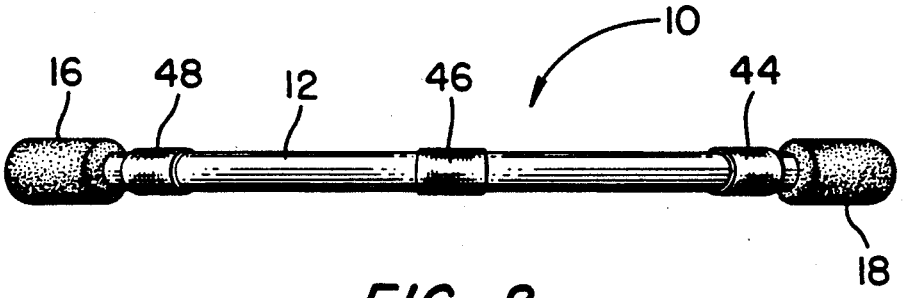
FIG. 2 is an elevation of the apparatus of FIG. 1.

With reference to the drawings, there is shown in FIG. 1 a game hoop apparatus 10 made in accordance with the present invention which includes a hoop member 12, a membrane member 14, shown as an open mesh, and a pair of handles 16, 18 which are mounted on the hoop member 12. The hoop member 12 is generally circular in the preferred embodiment and is made of a lightweight tubular material such as plastic.

Figure 3:
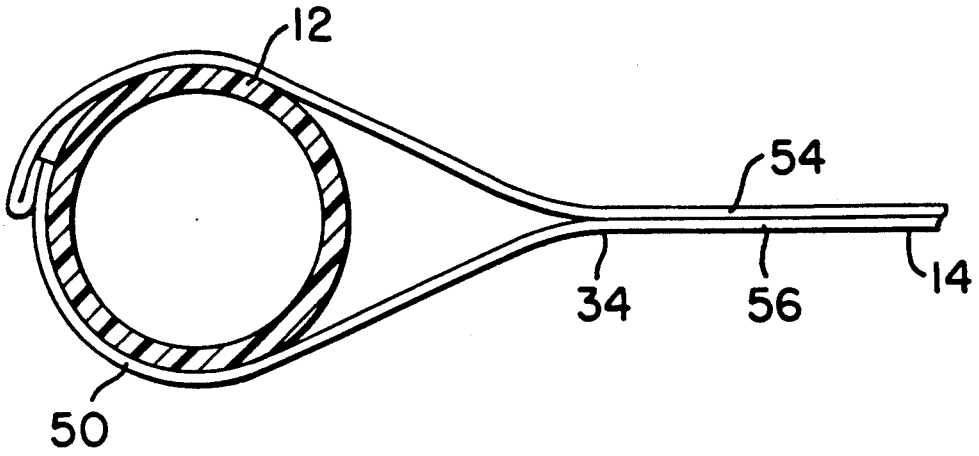
FIG. 3 is a fragmentary, cross-sectional view taken along the line 3—3 in FIG. 1 and drawn to an enlarged scale.

The membrane member 14 is attached to the hoop member 12 at selected locations along the circumference of the hoop member 12. In the preferred embodiment the membrane member 14 is a unitary member which has a central portion 20 and a plurality of attachment portions 22, 24, 26, 28, 30, 32, 34, 36 which project radially from the central portion 18. The ends of the attachment portions 22, 24, 26, 28, 30, 32, 34, 36 each have a loop 38, 40, 42, 44, 46, 48, 50, 52 as is best illustrated in FIGS. 1 and 3. The hoop member 12 passes through each of the loops 38, 40, 42, 44, 46, 48, 50, 52.

As best seen in FIG. 3, the membrane member 14, in the preferred embodiment, is formed of two layers 54, 56 of a fabric material which is woven, or knitted in a known manner so as to achieve desired elastic properties.

The construction of such fabric materials, which may be in the form of an open mesh, is well known and these fabrics are in wide use in the apparel industry and therefore the details of construction of the fabric material need not be further described.

As best seen in FIG. 1, the outer edge 56 of the membrane member 14 has a hem portion 60 which is formed by a line of stitches 62 in a conventional manner in order to join the two layers 54, 56.

The edges 64,66 of adjacent attachment portions 22, 24, 26, 28, 30, 32, 34, 36 are typically blended to form continuous curved portions as is best shown in FIG. 1.

The membrane member 14 is proportioned such that when the loops 38, 40, 42, 44, 46, 48, 50, 52 are attached to the hoop member 12, the entire membrane member 14 is stretched, or placed in a state of tension.

Alternatively, other types of elastic materials such as plastic films or rubber sheets may be used to form the membrane member.

The pair of handles 16, 18 are mounted on the hoop member 12 and form a key feature of the present invention. The handles 16, 18 are mounted on the hoop member 12 in a nearly facing relationship and are spaced apart from each other a distance which is less than one-half the circumference of the hoop member 12. The straight-line distance between the handles 16, 18 is less than the diameter of the hoop member 12. This straight line distance can be considered as a chord of the circle formed by the hoop member 12.

The handles 16, 18 are formed of a relatively soft tubular member which is preferably made of a soft flexible foam material.

Figure 4:
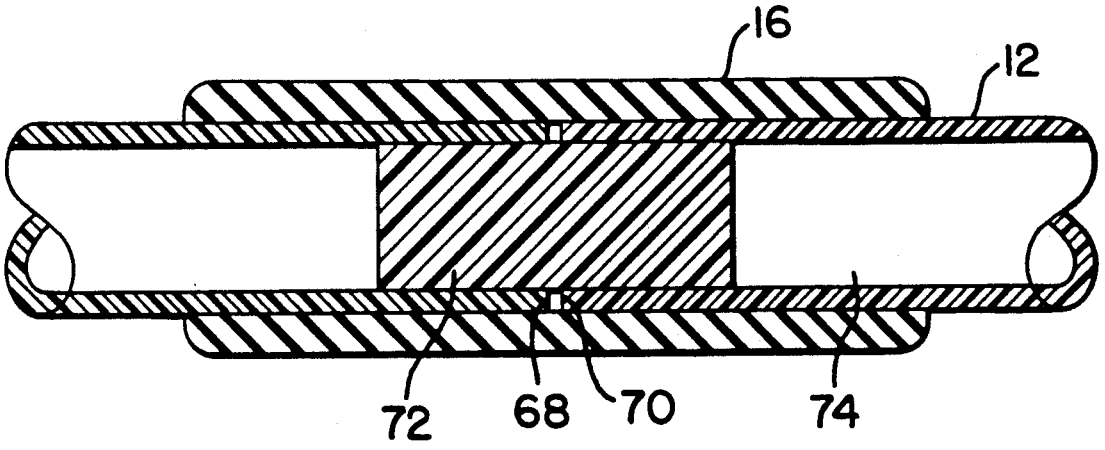
FIG. 4 is a cross-sectional view taken along the line 4—4 in FIG. 1.

The handle 16 covers the ends 68, 70 of the hoop member 12. As is best shown in FIG. 4 the ends 68, 70 of the hoop member 12 are joined by the plug member 72 which has been inserted into the hollow portion 74 of the hoop member 12.

Figure 5:
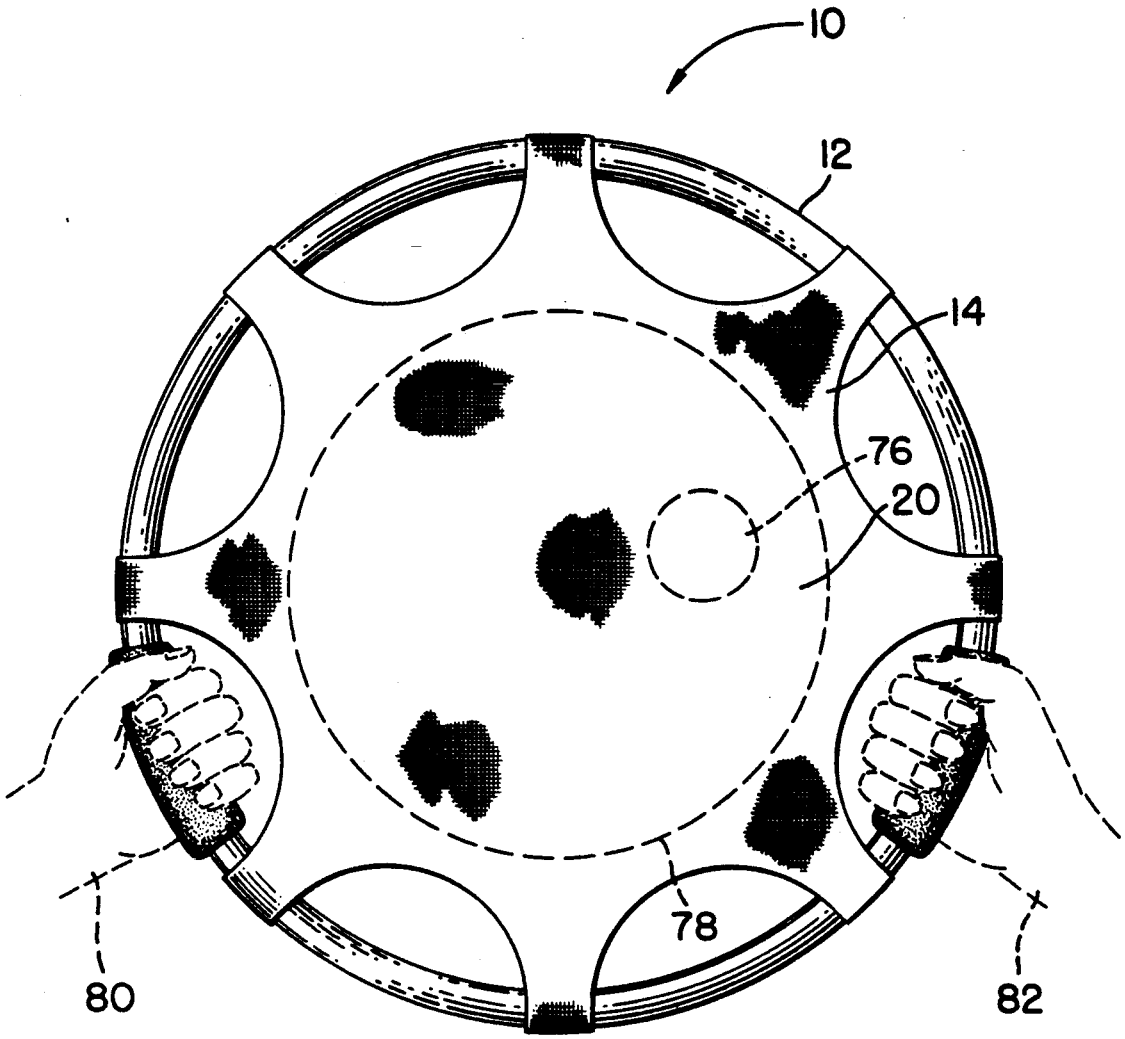
FIG. 5 is a plan view of the apparatus similar to FIG. 1 showing the apparatus being held by a player whose hands are shown in broken lines.

The placement of the handles 16, 18 as described above makes it convenient for a player to grasp the apparatus 10 with his arms extended in front of his body and with his palms facing each other. As is shown in FIG. 5, the apparatus 10 is grasped with both hands 80, 82 and the ball which is shown in broken lines 76 is caught and tossed back using the central portion 20 of the membrane member 14 which is outlined in broken lines 78.

During play, a player adjusts the position of the apparatus 10 to rebound or propel a ball by moving both of his hands and his body. The use of both hands leads to an increase in the coordinated use of both hands, as well as increased agility, coordinated bilateral movement and a beneficial level of exercise.

The ball used with the apparatus 10 may be a conventional lightweight ball made of plastic or rubber foam which enables the apparatus 10 to be used for either indoor or outdoor play. The ball used may also be a conventional hollow rubber ball.

The foregoing specific embodiment of the present invention as set forth in the specification herein is for illustrative purposes only. Various changes and modifications may be made within the spirit and scope of this invention.

What is claimed is:

1. A game hoop apparatus comprising in combination:

a circular hoop member having a circumference and a diameter and made of a lightweight tubular plastic material and having at least eight connection locations spaced equally about the circumference thereof, a membrane made of a resilient strong lightweight open mesh material and attached in tension to the hoop member at each of the connection locations by means of a loop portion which is formed as part of the membrane and extends around the hoop member whereby the hoop member passes through each of the loop portions so that the hoop member and the membrane coact as a single unit, a pair of handles each comprising a resilient tubular member with a hollow portion and the hoop member passing therethrough, the handles mounted on the hoop member at handle locations which are spaced apart from each other a distance which is less than the diameter of the hoop member, the handles enabling a player to grasp the game hoop with both hands, each of the handle locations situated between adjacents of the connection locations.

* * * * *